US008522937B2

(12) United States Patent
Saetia

(10) Patent No.: US 8,522,937 B2
(45) Date of Patent: Sep. 3, 2013

(54) BUSINESS CASE WITH REMOVABLE HANDLE AND WHEEL ASSEMBLY

(75) Inventor: Chettha Saetia, Chicago, IL (US)

(73) Assignee: McKlein Company, LLC, Chicago, IL (US)

( * ) Notice: Subject to any disclaimer, the term of this patent is extended or adjusted under 35 U.S.C. 154(b) by 325 days.

(21) Appl. No.: 12/804,053

(22) Filed: Jul. 13, 2010

(65) Prior Publication Data

US 2010/0307879 A1 Dec. 9, 2010

(51) Int. Cl.
*A45C 5/14* (2006.01)

(52) U.S. Cl.
USPC ..... 190/18 A; 190/102; 280/37

(58) Field of Classification Search
USPC ..... 190/18 A, 102, 108; 280/47.29, 280/36, 47.26, DIG. 3, DIG. 6, 37
See application file for complete search history.

(56) References Cited

U.S. PATENT DOCUMENTS

| | | | | | |
|---|---|---|---|---|---|
| 3,079,166 | A * | 2/1963 | Abgarian | 280/40 |
| 3,287,841 | A * | 11/1966 | Spragg et al. | 40/308 |
| 3,418,005 | A * | 12/1968 | Allina | 280/47.26 |
| 3,934,895 | A * | 1/1976 | Fox | 280/47.26 |
| 4,596,397 | A * | 6/1986 | Conti | 280/47.131 |
| 5,024,458 | A * | 6/1991 | Kazmark et al. | 280/645 |
| 5,323,886 | A * | 6/1994 | Chen | 190/18 A |
| 5,388,313 | A * | 2/1995 | Cameron | 24/537 |
| 5,529,322 | A * | 6/1996 | Barton | 280/30 |
| 5,549,318 | A * | 8/1996 | Ho | 280/654 |
| 5,749,446 | A * | 5/1998 | Hsieh | 190/107 |
| 5,797,617 | A * | 8/1998 | Lin | 280/655 |
| 5,829,558 | A * | 11/1998 | Cheng | 190/116 |
| 5,971,119 | A * | 10/1999 | Chi | 190/108 |
| 6,070,888 | A * | 6/2000 | Wang | 280/37 |
| 6,484,374 | B2 * | 11/2002 | McAllister | 24/557 |
| 6,899,346 | B2 * | 5/2005 | Pfeiffer | 280/47.29 |
| 6,994,193 | B2 * | 2/2006 | Saetia | 190/18 A |
| 7,036,641 | B2 * | 5/2006 | Russo et al. | 190/18 A |
| 7,165,661 | B2 * | 1/2007 | Miyoshi | 190/8 |
| 2002/0096862 | A1 * | 7/2002 | Fang | 280/652 |
| 2002/0195359 | A1 * | 12/2002 | Uner et al. | 206/315.3 |
| 2004/0183266 | A1 * | 9/2004 | Cambiano et al. | 280/47.26 |
| 2006/0071436 | A1 * | 4/2006 | O'Connor | 280/47.29 |
| 2006/0226619 | A1 * | 10/2006 | Sadow | 280/47.26 |
| 2007/0068757 | A1 * | 3/2007 | Tan | 190/18 A |

FOREIGN PATENT DOCUMENTS

JP 2006081525 A * 3/2006

* cited by examiner

*Primary Examiner* — Sue A Weaver
(74) *Attorney, Agent, or Firm* — Carmen Patti Law Group, LLC

(57) ABSTRACT

A luggage case system comprises a case, a wheel and handle assembly, and at least one clip. The case has a top, bottom, front, back and sides. The wheel and handle assembly comprises a partial housing including a bottom, a back, and sides, an extendable handle secured to said back. The partial housing conforms in shape to that of said case, such that said bottom of said case may be placed on the bottom of the partial housing, and said back and sides of said case will engage the back and sides of said partial housing. The at least one clip is configured to engage the case and the wheel and handle assembly to releasably secure the case to the wheel and handle assembly, whereby with said handle extended said case may be pulled by said handle.

25 Claims, 14 Drawing Sheets

BUSINESS CASE WITH REMOVABLE HANDLE AND WHEEL ASSEMBLY

FIELD OF THE INVENTION

The present invention relates to luggage, and more particularly to small luggage cases, such as business cases, computer cases, backpacks and the like which may be provided with shoulder straps or hand grips for carrying, or with wheels for rolling on a surface and an extendable handle for pulling by a user.

BACKGROUND OF THE INVENTION

In the past, most items of luggage, such as those used for overnight travel, were formed of stiff or rigid material as rigid enclosures. Similarly, items of luggage used to carry papers, personal items and other materials to be kept close at hand, particularly when using public transportation, such as airplane or trains, typically referred to as briefcases, where also either made of stiff or rigid material as rigid enclosures, or of rather stiff material such as leather with some flexible portions to permit expansion and contraction. More recently, both types of luggage mentioned above have been formed as relatively unstructured enclosures made of non-rigid natural or man-made materials such as leather, canvas or nylon. The non-rigid material forming the enclosure is assembled to provide luggage of a particular shape. In some cases, a rigid framework is provided to maintain the desired shape of the luggage.

A further development in luggage industry has been the use of wheeled luggage for checked baggage, carry-on baggage and some business cases. For the purposes of this discussion, the term "business case" may include cases designed to hold and transport portable computers. Luggage of this type typically includes wheels and an extendable handle, so that the user can pull the case along on its wheels, without having to bear its full weight. Additional items may be supported by the handle assembly or attached to the case itself, to ease the burden of the user when moving through airport concourses or along city sidewalks. Examples of such additional items are garment bags and other business cases.

The most commonly available luggage of this type has wheels and extendable handle permanently attached to the luggage. When luggage of this type is not being transported on its wheels, the extendable is retracted. When this arrangement is included as part of the design of a business case, the bulk and weight of the case, with its integrated wheel and handle assembly, is are often cumbersome and uncomfortable to carry.

For instance, the same case may be used during business trips and while commuting between home and office. On a business trip the integrated handle and wheel assembly is a blessing; on a commuter train, the bulk and weight of the assembly may be a curse. When such a business case or backpack is carried by shoulder straps or handles, the typically unpadded structure of the retracted handle and wheel assembly can irritate the user's rib cage.

Accordingly, it would be advantageous to provide a luggage system consisting of a case and a wheel and handle assembly which may be readily secured to the case when needed and removed when not needed. Further, it would be desirable to provide the readily removable wheel and handle assembly and the case with complementary devices for securing them to each other. It would be further desirable that the removable wheel and handle assembly and the case be of complementary design, so as to be of pleasing appearance when secured to each other. Finally, it would be desirable that the wheel and handle assembly provide extra strength to the case, particularly when it is fully packed and heavy.

SUMMARY

The invention in one implementation encompasses a luggage system which includes a case provided with straps or handles for carrying the case and a wheel and extendable handle assembly for dragging the case. It is a further object of this invention to provide a wheel and extendable handle assembly which may be removably attached to the case.

The invention in another implementation encompasses a case with a removable wheel and extendable handle assembly which are attached to each other by complementary fasteners provided on the case and the removable wheel and extendable handle assembly.

The invention in yet another implementation encompasses a removable wheel and extendable handle assembly which provides additional protection and rigidity to the case when attached to the case for dragging of the case.

The invention in another implementation encompasses a luggage case system comprises a case, a wheel and handle assembly, and at least one clip. The case has a top, bottom, front, back and sides. The wheel and handle assembly comprises a partial housing including a bottom, a back, and sides, an extendable handle secured to said back. The partial housing conforms in shape to that of said case, such that said bottom of said case may be placed on the bottom of the partial housing, and said back and sides of said case will engage the back and sides of said partial housing. The at least one clip is configured to engage the case and the wheel and handle assembly to releasably secure the case to the wheel and handle assembly, whereby with said handle extended said case may be pulled by said handle.

A case with removable wheel and extendable handle assembly in accordance with this invention includes a soft sided case having one or more main storage volumes made accessible by openings which may be held closed by fastening devices. The case may also have additional storage areas for as pockets on the sides of the walls of the main storage areas. Handles are secured to the walls of the main storage area for a person to grasp while carrying the case. In of the preferred embodiments of this invention, straps are secured to the walls of the main storage area which may be used to carry to case as a back pack. A removable wheel and extendable handle assembly in accordance with this invention includes a partial housing having a base, sides and a back. A pair of wheels are mounted on the partial housing adjacent the corners formed by the base, sides and back. The back is provided with an arrangement for telescopically receiving an extendable handle assembly. In a preferred embodiment of this invention, the back of the partial housing is of essentially the same height as the case, the base is of essentially the same width and depth as the case, and the sides are of reduced height as compared to the back. Complimentary fastening devices are provided on the removable wheel and extendable handle assembly and on the case, the removable secure the assembly to the case. In a preferred embodiment of this invention, the complimentary fastening devices are in the form of zippers, similar to those used to provide access to the main storage volume and the auxiliary storage volumes. More particularly, one portion of a zipper is secured around the edge of the back of the partial housing, while the other portion of the zipper is provided on the case, such that when the case is place in the partial housing, the zipper portions may be secured to each other in the usual manner. Similarly, one portion of a zipper may be provided on the edge of the bottom opposite the back, and the other portion on the case, such that when the case is placed in the partial housing, the zipper portions may be secured to each other in the usual manner.

DETAILED DESCRIPTION OF THE PREFERRED EMBODIMENT

Figure 1:
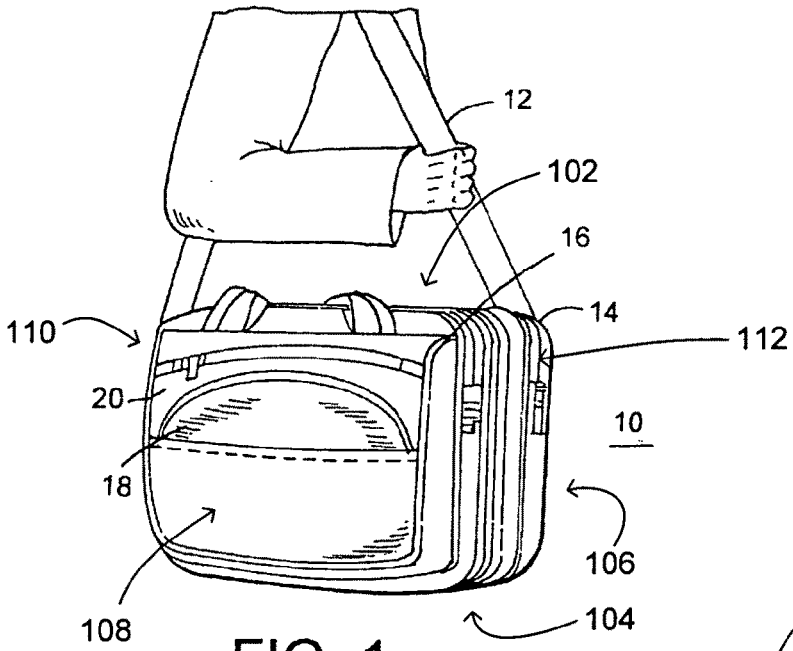
FIG. 1 is a general perspective view of a business case in accordance with the preferred embodiment of this invention transported as a brief case.

Referring to FIG. 1, a case 10 in one example comprises a business case 10 and/or a luggage case 10. The business case 10 in accordance with a preferred embodiment of this invention is provided with a shoulder strap 12 so as to be carried by the user. Business case 10 is generally of a rectangular shape, with access being provided to three main storage compartments by zippers 14 and 16. Auxiliary storage compartments 18 and 20 are provided on one side of the case 10.

The luggage case 10 in one example comprises a small luggage case 10. The small luggage case 10 in one example comprises top 102, bottom 104, face 106, face 108, side 110, and side 112. From one user perspective the face 106 comprises a front of the small luggage case 10 and from another user perspective the face 108 comprises a front of the small luggage case 10.

The small luggage case 10 comprises a first dimension, for example, a height, between the top 102 and the bottom 104. The small luggage case 10 comprises a second dimension, for example, a width, between the side 110 and the side 112.

Figure 2:
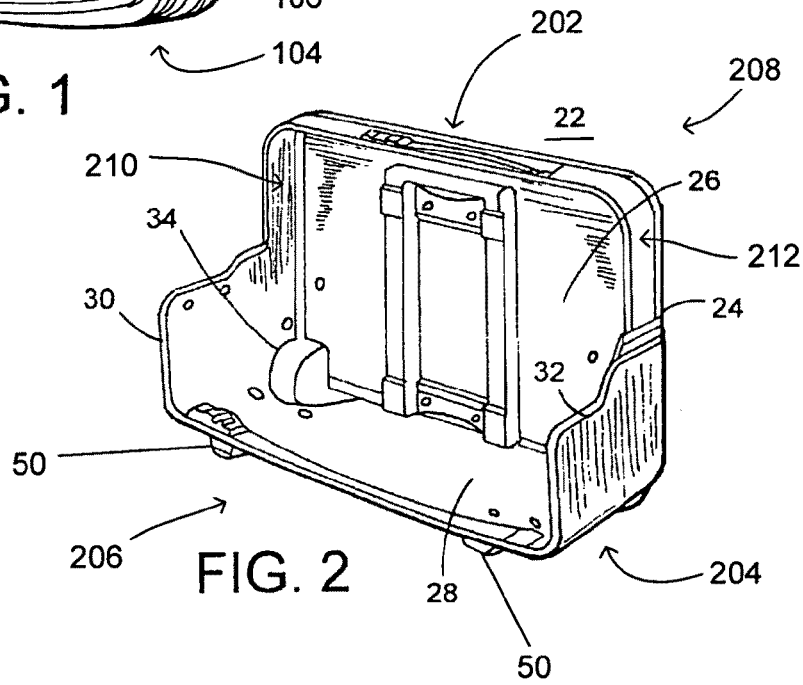
FIG. 2 is a perspective view of a removable wheel and extendable handle assembly in accordance with this invention for use with the case shown in FIG. 1.
Figure 8:
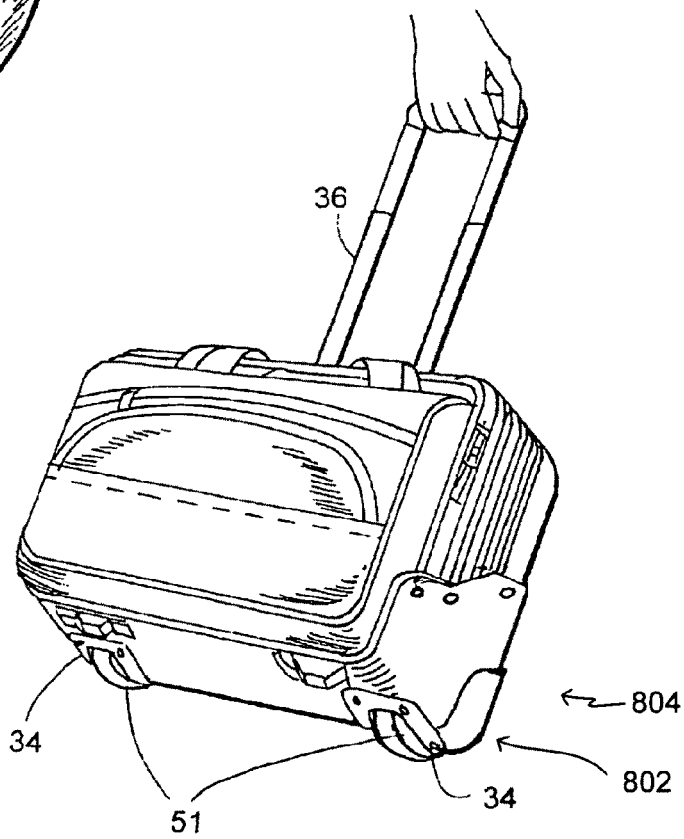
FIG. 8 is a perspective view showing the case of FIG. 1 secured in the removable wheel and extendable handle assembly of FIG. 2, with the extendable handle extended and being used to pull the case.

Referring to FIG. 2, wheel and handle assembly 22 in accordance with this invention is shown to include a partial housing shell 24. Shell 24 includes back 26, base 28 and side members 30 and 32. Wheel housings 34 are formed in the rear base of shell 24. Wheels 51 are rotatably mounted within wheel housings 34 as shown in FIG. 8. Telescoping extendable handle 36 is slidably mounted to the interior of shell back 26 by upper bracket 38 and lower bracket 40. Shell back 26 includes surround gusset 42 which extends around the upper perimeter of shell back 26 to form a flexible top and upper sides of shell 24. Access zipper 44 is provided in surround gusset 42 to provide access, when open, for handle 36, and through which handle 36 is extended.

Upper zipper half 46 is stitched to the leading edge of surround gusset 42. Lower zipper half 48 is stitched to the leading edge of shell base 28. Support feet 50 are provided on the bottom of base 28.

Figure 6:
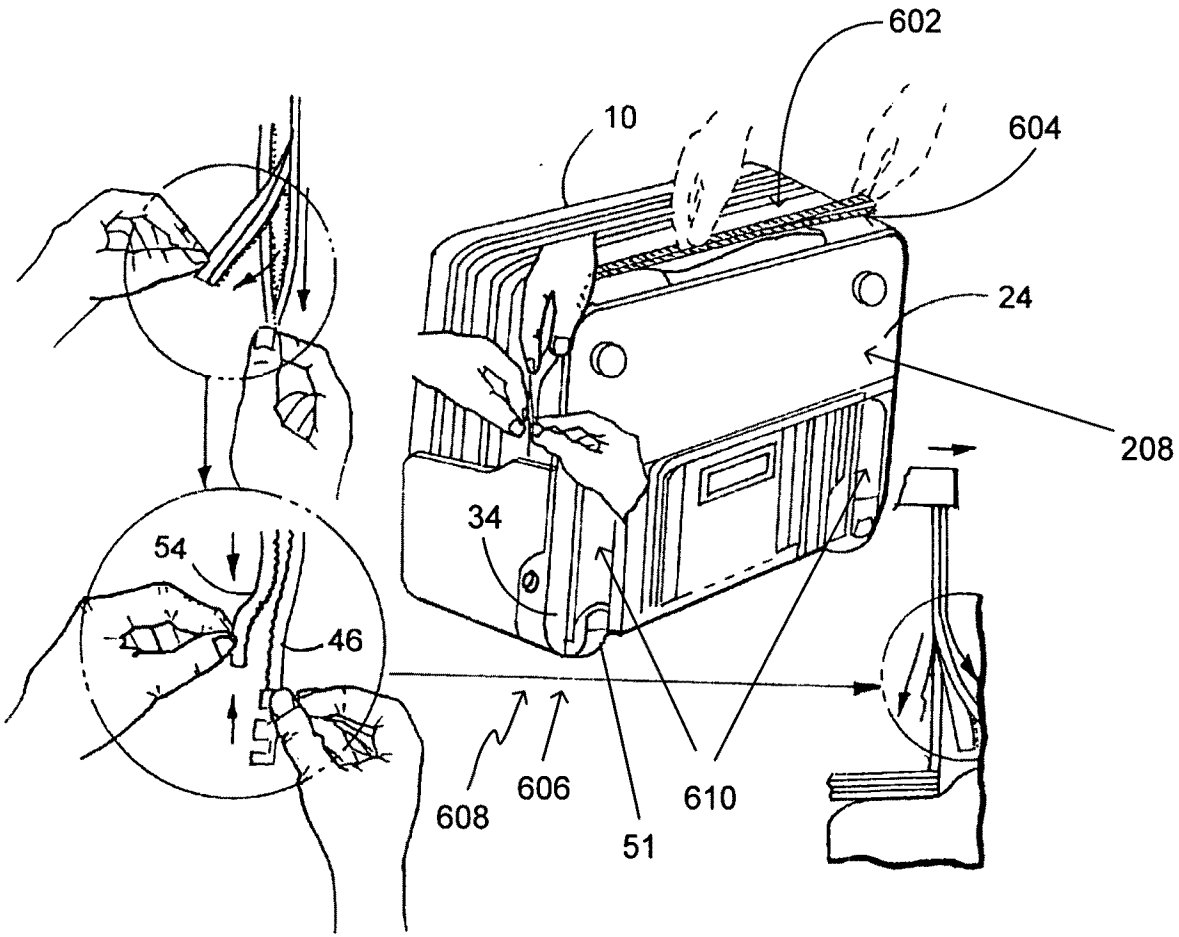
FIG. 6 is a rear perspective view showing the case of FIG. 1 placed in the removable wheel and extendable handle assembly of FIG. 2, and a series of detail figures illustrating the attachment process at the top and sides of the combined assembly.

Referring to FIGS. 2 and 6, the wheel and handle assembly 22 in one example comprises the shell 24, the wheel housings 34, top 202, bottom 204, face 206, face 208, side 210, side 212, and skid plates 610. From one user perspective the face 206 comprises a front of the wheel and handle assembly 22 and from another user perspective the face 208 comprises a front of the wheel and handle assembly 22.

The wheel and handle assembly 22 comprises a first dimension, for example, a height, between the top 202 and the bottom 204. The wheel and handle assembly 22 comprises a second dimension, for example, a width, between the side 210 and the side 212.

Figure 5:
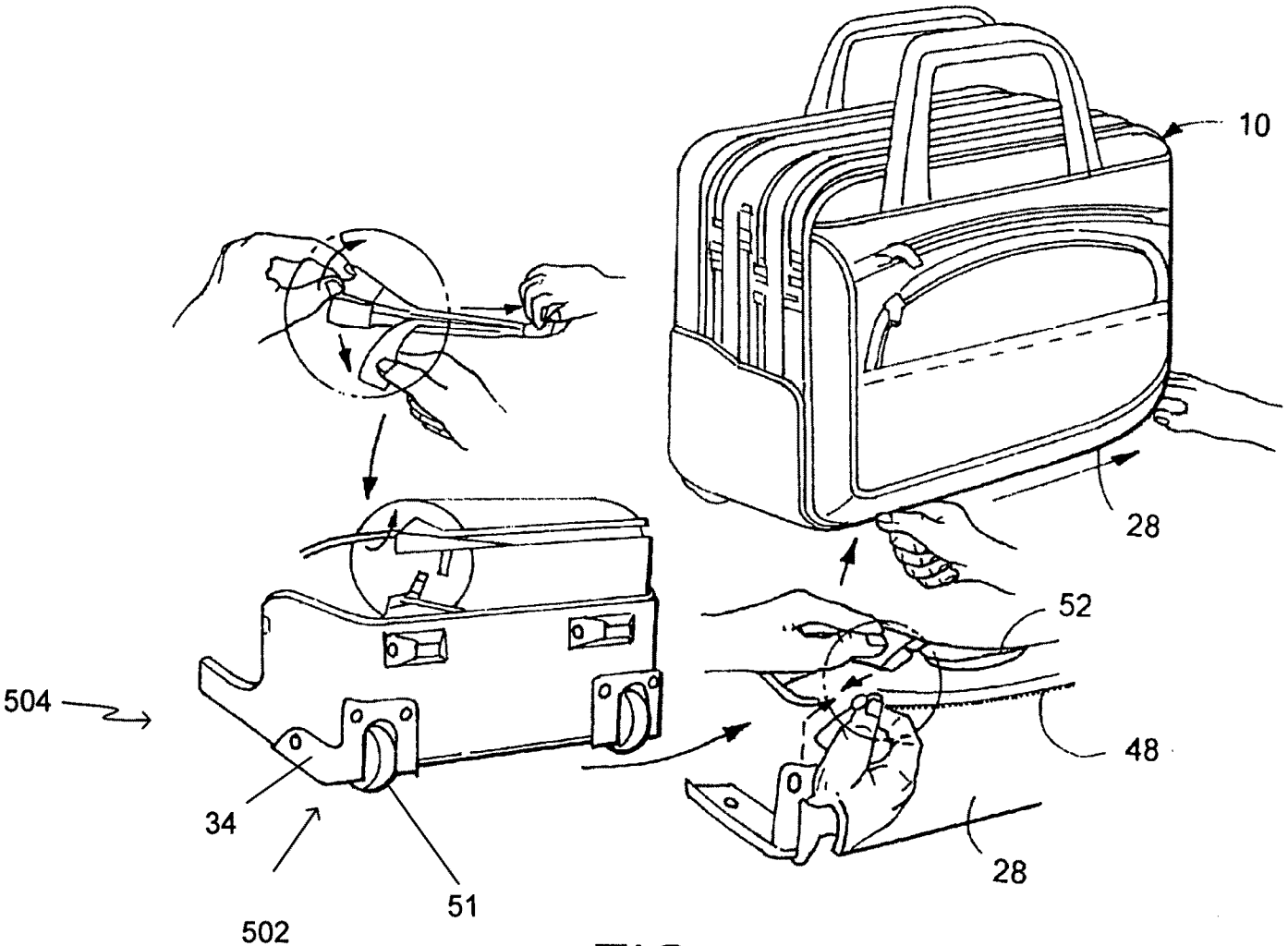
FIG. 5 is a front perspective view showing the case of FIG. 1 placed in the removable wheel and extendable handle assembly of FIG. 2, and a series of detail figures illustrating the attachment process at the bottom of the combined assembly.

Referring to FIGS. 5, 6, and 8, the wheel housings 34 in one example cover various portions of the wheels 51. Referring to FIG. 5, the wheel housings 34 cover portion 502 of the wheels 51 at position 504 of the wheel and handle assembly 22. Referring to FIG. 6, the wheel housings 34 cover portion 606 of the wheels 51 at position 608 of the wheel and handle assembly 22. Referring to FIG. 6, the wheel housings 34 cover portion 802 of the wheels 51 at position 804 of the wheel and handle assembly 22.

Figure 4:
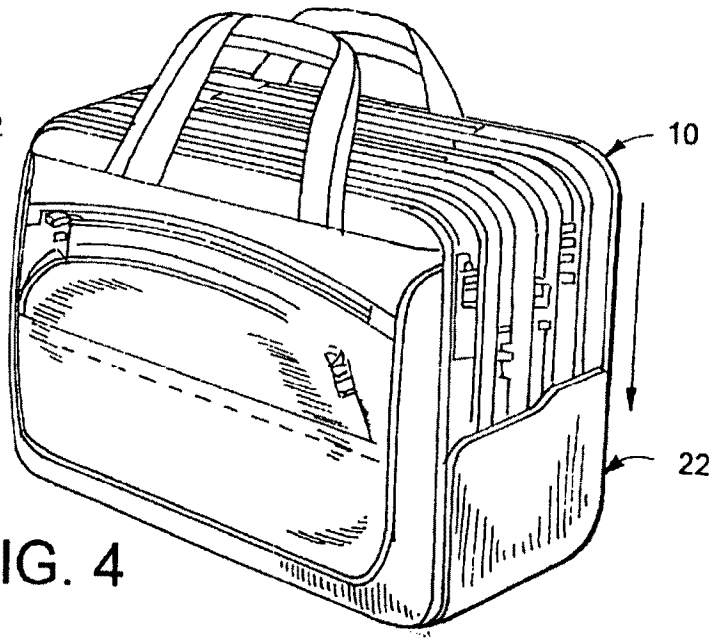
FIG. 4 is a perspective view showing the case of FIG. 1 placed in the removable wheel and extendable handle assembly of FIG. 2.
Figure 3:
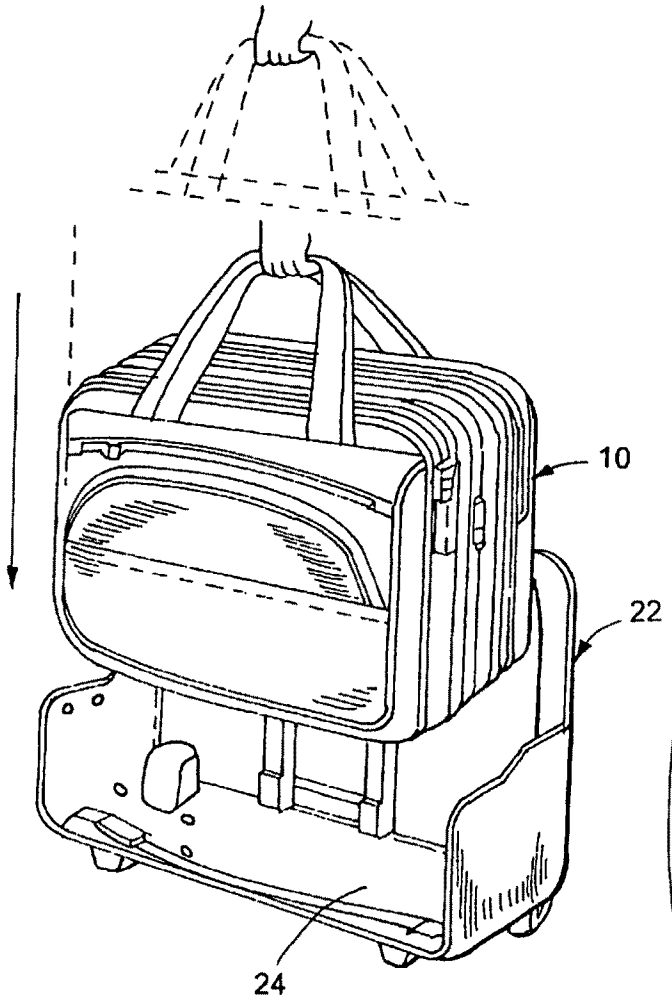
FIG. 3 is a perspective view showing the manner of placement of the case of FIG. 1 in the removable wheel and extendable handle assembly of FIG. 2.

Referring to FIGS. 3 and 4, business case 10 is shown being lowered and inserted in housing shell 24 of wheel and handle assembly 22. Shell 24 is sized to provide a snug fit around case 10.

The small luggage case 10 is readily releasably securable to the wheel and handle assembly 22. Upon readily releasable securement in one example, the face 106 of the small luggage case 10 abuts the face 206 of the wheel and handle assembly 22. The top 102 of the small luggage case 10 is adjacent to the top 202 of the wheel and handle assembly 22. The bottom 104 of the small luggage case 10 is adjacent to the bottom 204 of the wheel and handle assembly 22. The side 110 of the small luggage case 10 is adjacent to the side 210 of the wheel and handle assembly 22. The side 112 of the small luggage case 10 is adjacent to the side 212 of the wheel and handle assembly 22.

Referring to FIG. 5, business case 10 is attached to the leading edge of shell base 28. The means of attachment in the illustrated embodiment zippers at the front bottom edge of the assembly and at the back top and sides of the assembly. It is anticipated, however, that other suitable attaching means could be used, including snaps and hook and loop fastening means. In addition, it is anticipated that the fastening means used in the various embodiments of the present invention could be lockable to secure business case 10 to shell base 28. In this embodiment, the lower frontal attachment is made by mating zipper half 52, stitched to the front bottom edge of case 10, and lower zipper half 48, stitched to the leading edge of shell base 28.

Similarly, as shown in FIG. 6, zipper half 54, stitched adjacent to and around the upper rear sides and the top rear edge of case 10, and upper zipper half 46 on shell 24 are sized and located to mate, forming a complete zipper around the rear top edge and upper rear sides of the assembly.

The small luggage case 10 comprises perimeter 602 about the face 106. The zipper half 54 in one example is stitched along a number of portions of the perimeter 602. For example, the zipper half 54 is stitched along the side 110, the top 102, and the side 112.

The wheel and handle assembly 22 comprises perimeter 604 about the face 206. The upper zipper half 46 in one example is stitched along a number of portions of the perimeter 604. For example, the upper zipper half 46 is stitched along the side 210, the top 202, and the side 212.

Figure 7:
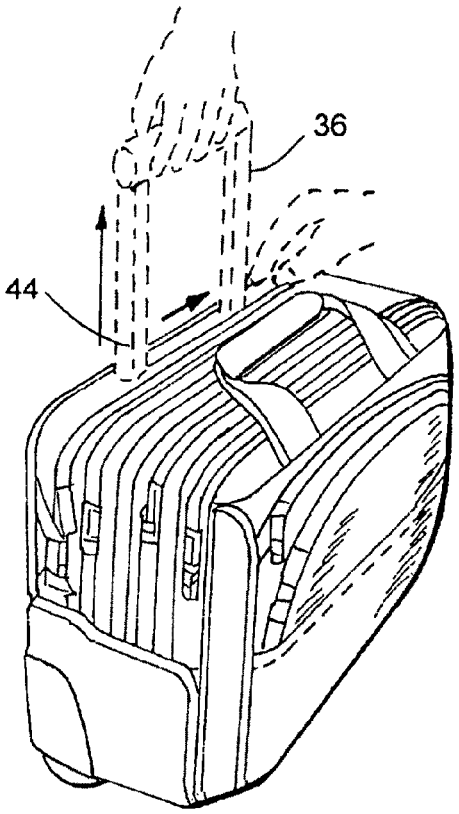
FIG. 7 is a perspective view showing the case of FIG. 1 being finally secured in the removable wheel and extendable handle assembly of FIG. 2, with the extendable handle partially extended.

FIGS. 7 and 8 illustrate the completely assembled unit. In FIG. 7, telescoping extendable handle 36 is extracted from access zipper 44 so that the case may be pulled behind the user.

Figure 9:
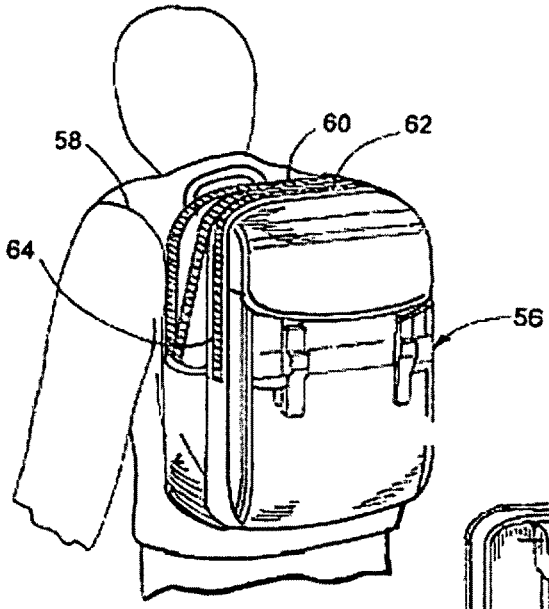
FIG. 9; is a general perspective view of a back pack in accordance with an alternative embodiment this invention.
Figure 10:
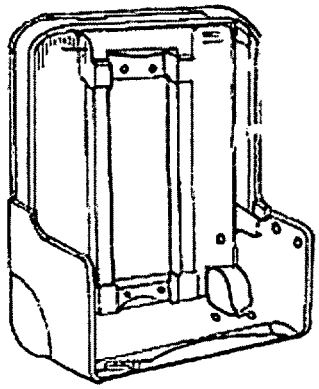
FIG. 10 is a perspective view of a removable wheel and extendable handle assembly in accordance with this invention for use with the case shown in FIG. 9.
Figure 11:
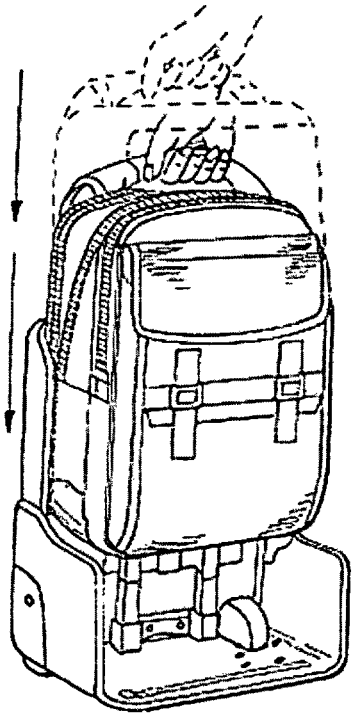
FIG. 11 is a perspective view showing the manner of placement of the case of FIG. 9 in the removable wheel and extendable handle assembly of FIG. 10.
Figure 12:
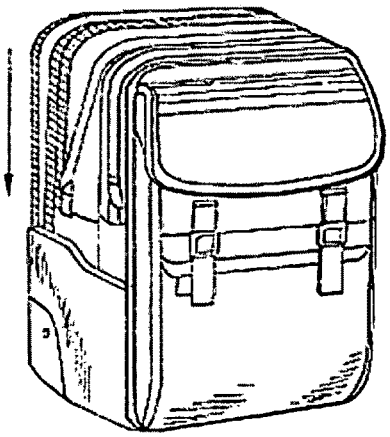
FIG. 12 is a perspective view showing the case of FIG. 9 placed in the removable wheel and extendable handle assembly of FIG. 10.
Figure 13:
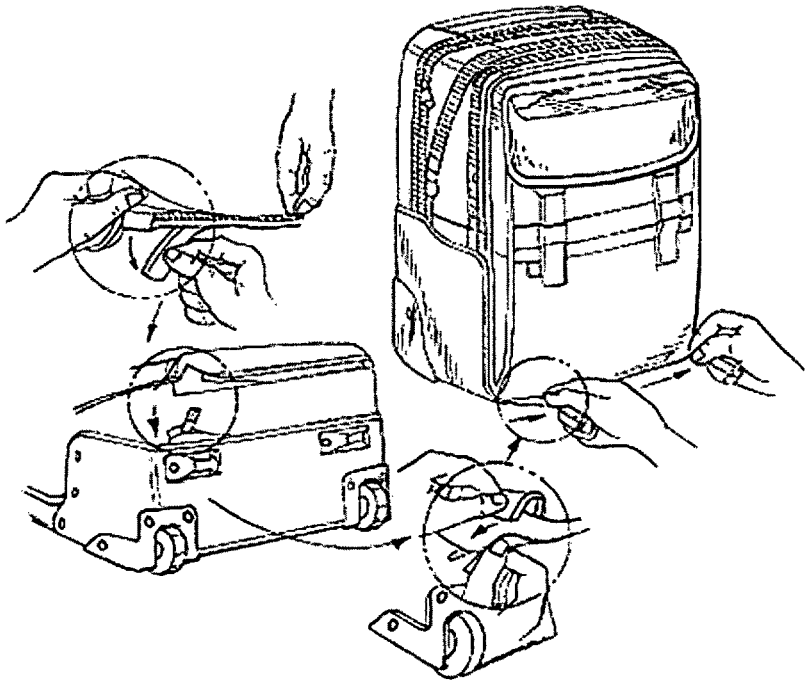
FIG. 13 is a perspective view showing the case of FIG. 9 placed in the removable wheel and extendable handle assembly of FIG. 10, and a series of detail figures illustrating the attachment process at the bottom of the combined assembly.
Figure 14:
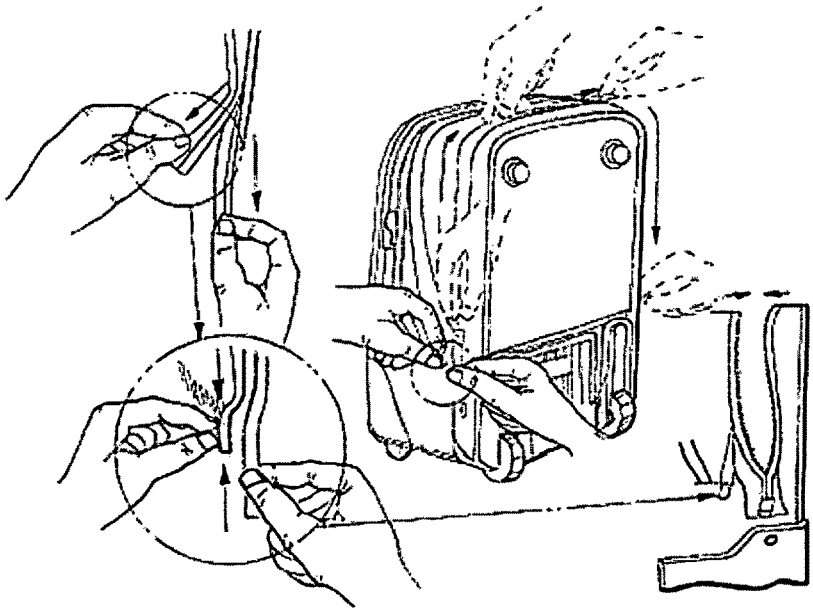
FIG. 14 is a perspective view showing the case of FIG. 9 placed in the removable wheel and extendable handle assembly of FIG. 10, and a series of detail figures illustrating the attachment process at the top and sides of the combined assembly.
Figure 15:
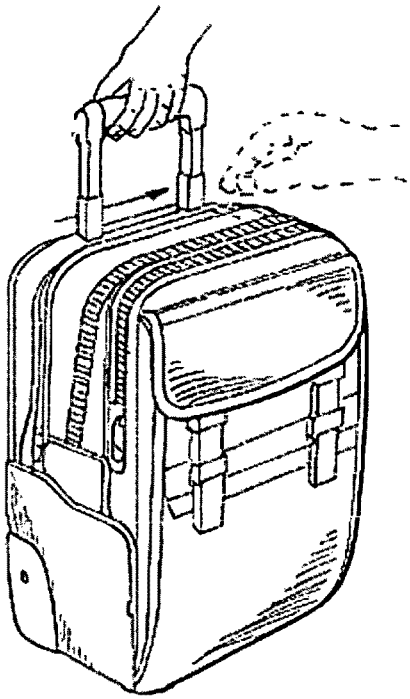
FIG. 15 is a perspective view showing the case of FIG. 9 being finally secured in the removable wheel and extendable handle assembly of FIG. 10, with the extendable handle partially extended.
Figure 16:
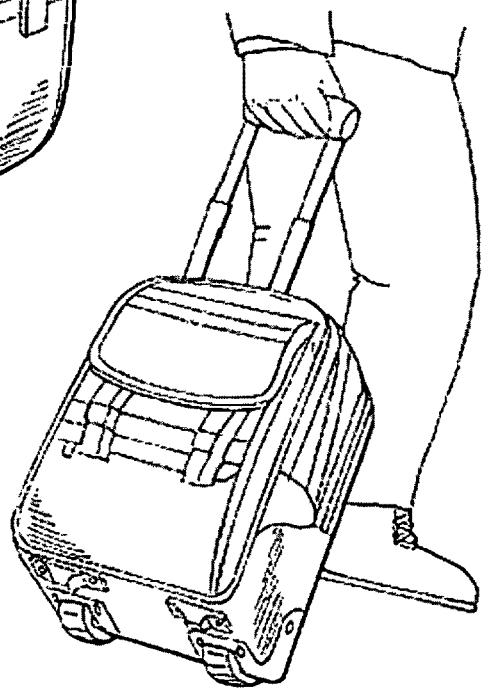
FIG. 16 is a perspective view showing the case of FIG. 9 secured in the removable wheel and extendable handle assembly of FIG. 10, with the extendable handle extended and being used to pull the case.

An alternative embodiment of the present invention is shown in FIGS. 9-16. Referring to FIG. 9, back pack 56 is provided with a pair of shoulder straps 58, one of which is shown, so as to be carried by the user. The back pack 56 is generally of a rectangular shape, with access being provided to three main storage compartments by zippers 60, 62, and 64. Auxiliary storage compartments 66, 68, 70 are provided on one side of back pack 56. This embodiment of the present invention differs from the previously described embodiment only in that back pack 56 is vertical in aspect rather than horizontal like business case 10 of the first described embodiment.

Figure 17:
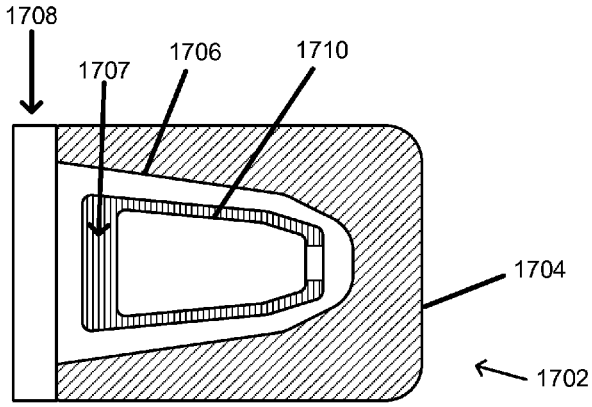
FIG. 17 is a perspective view showing a clip for removably securing a case to a wheel and handle assembly.
Figure 18:
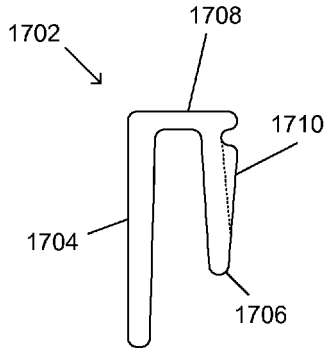
FIG. 18 is a side view of the clip of FIG. 17.
Figure 19:
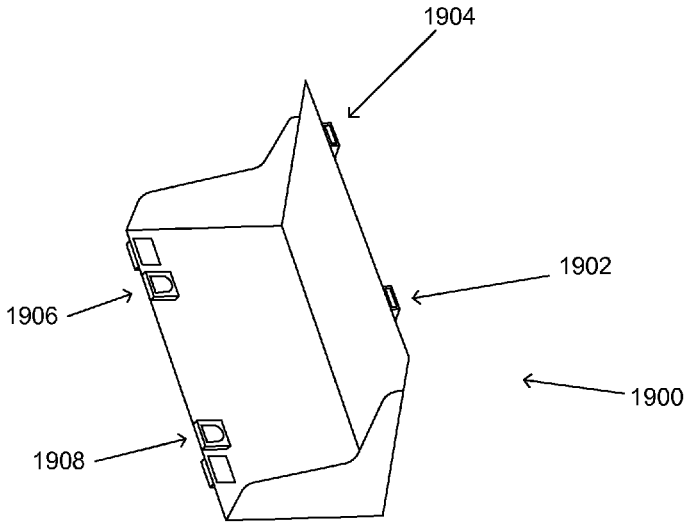
FIG. 19 is a partial front perspective view of another implementation of the wheel and handle assembly with another implementation of the case.
Figure 20:
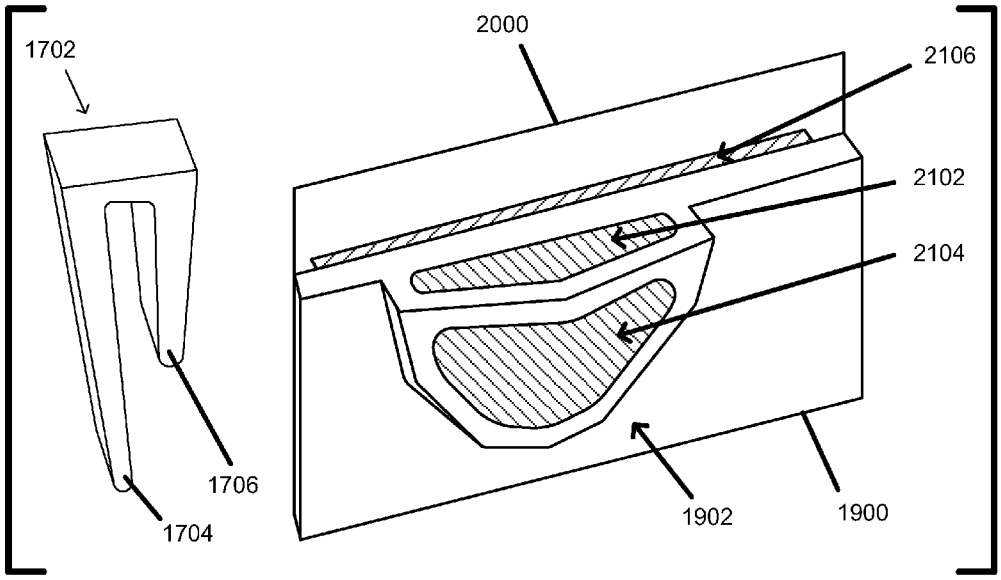
FIG. 20 is a partial rear perspective view of the case and wheel and handle assembly of FIG. 19 with the clip of FIG. 17.
Figure 21:
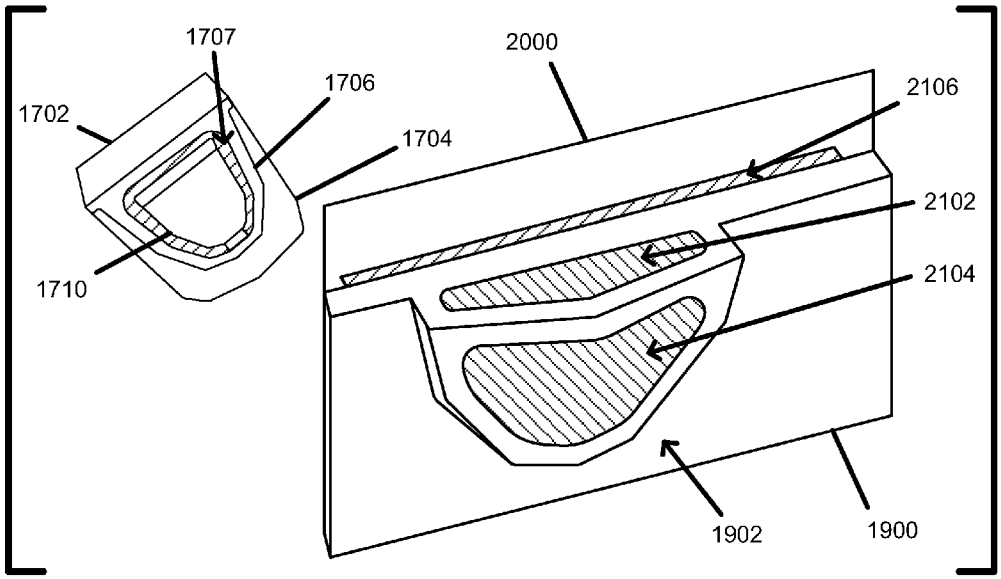
FIG. 21 is another partial rear perspective view of the case and wheel and handle assembly of FIG. 19 with the clip of FIG. 17 and illustrates engagement points of the wheel and handle assembly.
Figure 22:
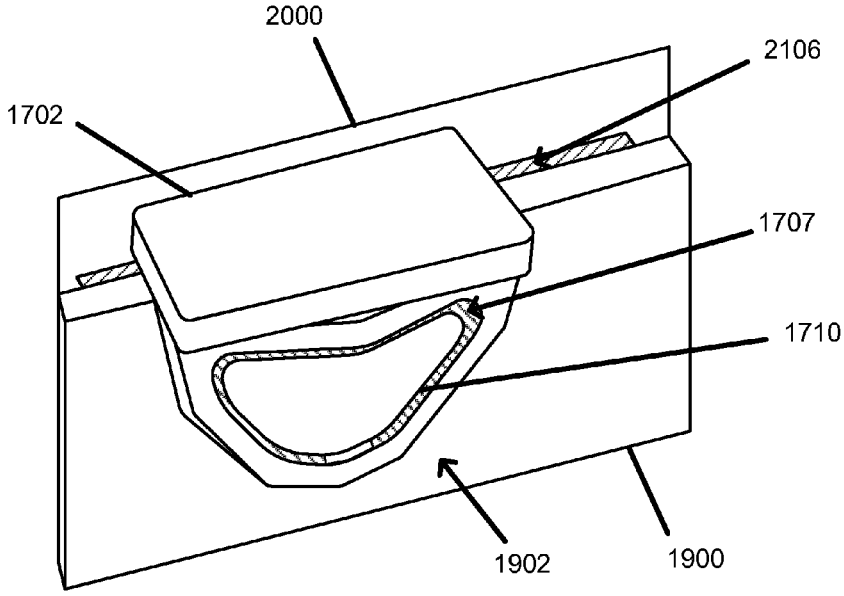
FIG. 22 is a partial rear perspective view of the case and wheel and handle assembly of FIG. 19 engaged with the clip of FIG. 17.

Turning to FIGS. 17 and 18, at least one clip 1702 in one example is configured to engage a wheel and handle assembly 1900 (FIG. 19) and a case 2000 (FIG. 20). The wheel and handle assembly 1900 and case 2000 are similar to the wheel and handle assembly 22 and case 10, respectively, with an attachment mechanism provided by at least one clip 1702. Upon engagement of the clip 1702, the case 2000 is securely coupled with the wheel and handle assembly 1900. The clip 1702 may be released from engagement by a user to allow separation of the case 2000 from the wheel and handle assembly 1900, as will be appreciated by those skilled in the art.

The clip 1702 comprises a first tab 1704, a second tab 1706, and a bridge 1708. The first tab 1704, second tab 1706, and bridge 1708 in one example are formed as an integral component, for example, as a single, injection-molded piece. The second tab 1706 in one example comprises a partial window 1707 with a pressure tab 1710 therein. The pressure tab 1710 is configured to be elastically flexible within the partial window 1707, as described herein. The bridge 1708 is configured to be pushed by a user to effect engagement of the clip 1702 with the case 2000 and the wheel and handle assembly 1900.

Figure 25:
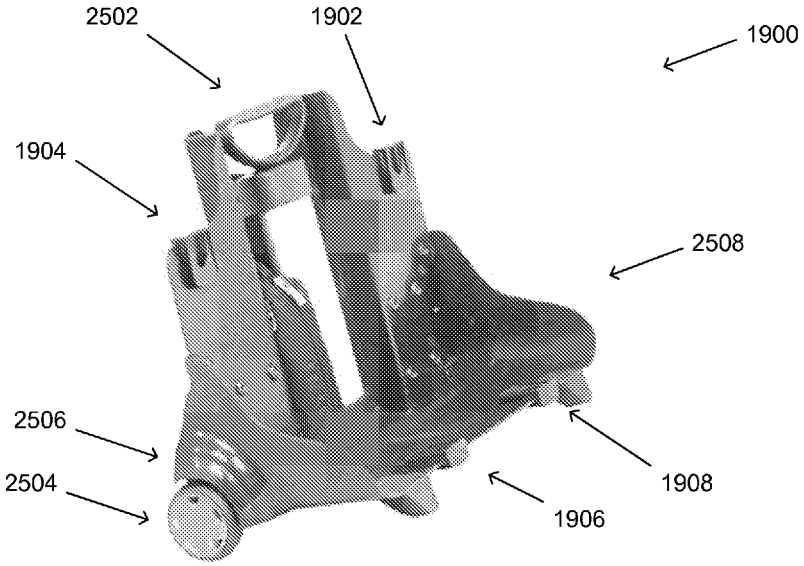
FIG. 25 is a front perspective view of the wheel and handle assembly of FIG. 19.

Turning to FIGS. 19 and 25, another implementation of a wheel and handle assembly 1900 is shown. The wheel and handle assembly 1900 comprises one or more slots configured to engage the clip 1702, for example, slots 1902, 1904, 1906, and 1908. The slots of the wheel and handle assembly 1900 and the slots of the case 2000 in one example are configured to be complementary pairs such that a complementary pair of slots is coupled with a single clip. The slots 1902 and 1904, 1906, and 1908 are positioned along an outer edge of the wheel and handle assembly 1900 to allow engagement of the clips 1702 with the case 2000 for securement of the case 2000 to the wheel and handle assembly 1900. Slots 1902 and 1904 are positioned along an upper, rear edge of the wheel and handle assembly 1900 and slots 1906 and 1908 are positioned along a lower, front edge of the wheel and handle assembly 1900. In FIG. 19, slots 1904, 1906, and 1908 have clips 1702 inserted therein.

A telescoping extendable handle 2502, analogous to handle 36, is shown in a collapsed position. Wheels 2504 are rotatably mounted within a wheel housing 2506, similarly to wheels 51 and housing 34 described above. In this implementation, the wheel housing 2506 extends outwards from the wheel and handle assembly 1900 which provides a more even interior face within a partial housing 2508 for receiving the case 2000.

Figure 23:
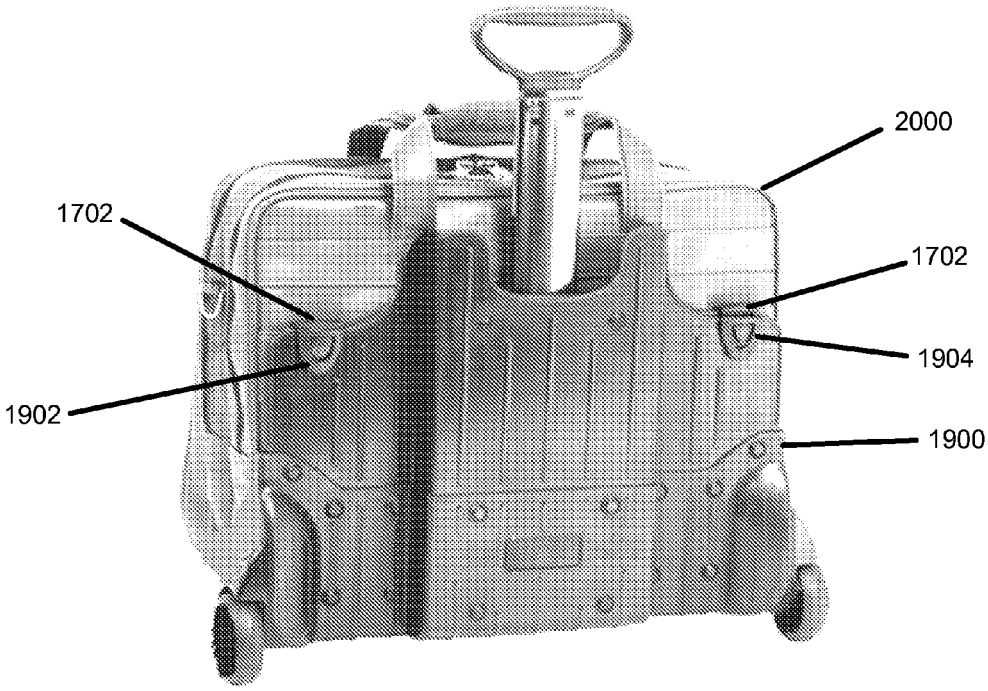
FIG. 23 is another partial rear perspective view of the case and wheel and handle assembly of FIG. 19 engaged with the clip of FIG. 17 where the clip is in a closed engagement position.

Turning to FIGS. 20-24, the slot 1902 comprises a first opening 2102 and a second opening 2104. The first opening is configured to receive the second tab 1706 and the second opening 2104 is configured to receive the pressure tab 1710. In one example, the first opening 2102 is sized such that the pressure tab 1710 is elastically bent inwards (e.g., under pressure) through the partial window 1707 towards the first tab 1704 as the second tab slides through the first opening and the clip 1702 slides into a closed engagement position (FIG. 23). In one example, the bridge 1708 abuts an edge or face of the slot 1902 when in the closed engagement position, as will be appreciated by those skilled in the art.

The second tab 1706 is configured to slide into the first opening 2102 until the elastically bent pressure tab 1710 is positioned in the second opening 2104, which releases the pressure on the pressure tab 1710 and allows it to return to its original shape. In this position, the pressure tab 1710 engages the second opening 2104 to prevent the clip 1702 from sliding out of the closed engagement position. The user can apply pressure (e.g., with a thumb or finger) to the pressure tab 1710 to elastically bend the pressure tab 1710, which allows for the clip 1702 to be pulled or otherwise removed from the first opening 2102 for disengagement of the clip 1702 and release of the case 2000 from the wheel and handle assembly 1900.

Figure 24:
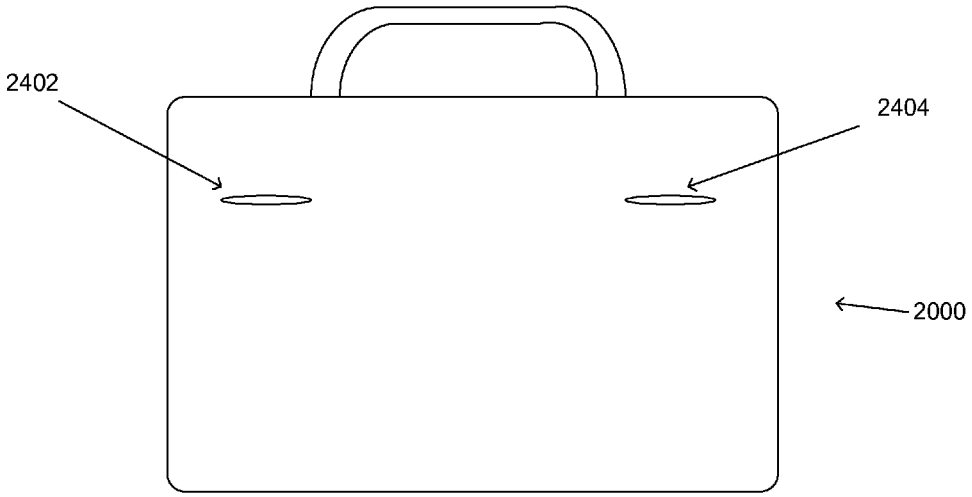
FIG. 24 is a rear view of the case of FIG. 19.

The case 2000 comprises one or more slots 2106 for receiving the first tab 1704 of the clip 1702. The slot 2106 in one example comprises a slot, pouch, or other opening in the case 2000 adapted to receive the first tab 1704 of the clip 1702. Turning to FIG. 24, a rear face of the case 2000 in one example comprises two slots 2402 and 2404 for engagement with two separate clips 1702 at the slots 1902 and 1904, respectively. In another example, a single slot 2106 is adapted to receive multiple clips 1702, such as a single slot along the back of the case 2000. For example, a single slot may be provided that extends from slot 1902 to 1904 to receive the clips 1702 at those locations. In another example, a pocket or compartment of the case 2000 may act as a slot 2106. The first tab 1704 is configured to slide into the slot 2106 as the second tab 1706 slides into the first opening 2102 of the slot 1902. With the clip 1702 in the closed engagement position, the first tab 1704 prevents the case 2000 from pulling away from an engagement face of the wheel and handle assembly 1900, as will be appreciated by those skilled in the art.

While several embodiments of the invention have been shown, it should be apparent to those skilled in the art that what has been described is considered at present to be a preferred embodiment of the roller wheel assembly for a tracked vehicle of this invention. In accordance with the Patent Statute, changes may be made in the roller wheel assembly for a tracked vehicle without actually departing from the true spirit and scope of this invention. The appended claims are intended to cover all such changes and modification which fall in the true spirit and scope of this invention.

What is claimed is:

1. A luggage case system comprising:

a case having a top, bottom, front, back and sides;

a wheel and handle assembly, comprising a partial housing including a bottom, a back, and sides, an extendable handle secured to said back, said partial housing conforming in shape to that of said case, such that said bottom of said case may be placed on the bottom of the partial housing, and said back and sides of said case will engage the back and sides of said partial housing;

at least one clip configured to engage the case and the wheel and handle assembly to readily releasably secure the case to the wheel and handle assembly, wherein the clip comprises a first tab, a second tab, and a bridge;

wherein the at least one clip is configured for disengagement from the case and from the wheel and handle assembly;

wherein the case comprises a slot configured to receive the first tab of the clip;

wherein the wheel and handle assembly comprises a slot configured to receive the second tab of the clip;

wherein the slot of the case and the slot of the wheel and handle assembly are complementary;

whereby with said handle extended said case may be pulled by said handle.

2. The luggage case system of claim 1, wherein first tab, the second tab, and the bridge are formed as an integral component.

3. The luggage case system of claim 1, wherein the second tab comprises a partial window with a pressure tab therein;

wherein the pressure tab is configured to be elastically flexible within the partial window.

4. The luggage case system of claim 3, wherein the slot of the wheel and handle assembly comprises a first opening and a second opening;

wherein the first opening is configured to receive the second tab of the clip;

wherein the second opening is configured to receive the pressure tab of the clip.

5. The luggage case system of claim 1, wherein the at least one clip comprises a first clip and a second clip.

6. The luggage case system of claim 5, wherein the slot of the case is configured to receive a first tab of the first clip and a first tab of the second clip.

7. The luggage case system of claim 6, wherein the slot of the case comprises a pocket or compartment of the case.

8. The luggage case system of claim 1, wherein the at least one clip is formed as an integral component and is separate from the case and the wheel and handle assembly.

9. The luggage case system of claim 8, wherein the at least one clip is formed as a single, injection-molded piece.

10. The luggage case system of claim 1, wherein the at least one clip is configured for complete disengagement from the case and from the wheel and handle assembly.

11. The luggage case system of claim 1, wherein the clip is configured to be removable from the slot of the wheel and handle assembly and removable from the slot of the case.

12. The luggage case system of claim 11, wherein the first tab is removable from the slot of the case;

wherein the second tab is removable from the wheel and handle assembly.

13. The luggage case system of claim 1, wherein the slot of the case comprises a pocket of the case.

14. A luggage case system comprising:

a case having a top, bottom, front, back and sides;

a wheel and handle assembly, comprising a partial housing including a bottom, a back, and sides, an extendable handle secured to said back, said partial housing conforming in shape to that of said case, such that said bottom of said case may be placed on the bottom of the partial housing, and said back and sides of said case will engage the back and sides of said partial housing, whereby with said handle extended said case may be pulled by said handle;

at least one clip configured to engage the case and the wheel and handle assembly to readily releasably secure the case to the wheel and handle assembly, wherein the clip comprises a first tab, a second tab, and a bridge, wherein the second tab comprises a partial window with a pressure tab therein;

wherein the case comprises a slot configured to receive the first tab of the clip and the wheel and handle assembly comprises a slot configured to receive the second tab of the clip, wherein the slot of the case and the slot of the wheel and handle assembly are complementary;

wherein the pressure tab is configured to be elastically flexible within the partial window;

wherein the slot of the wheel and handle assembly comprises a first opening configured to receive the second tab of the clip and a second opening configured to receive the pressure tab of the clip;

wherein the first opening is sized such that the pressure tab is elastically bent through the partial window, from a first position to a second position, towards the first tab as the second tab slides through the first opening.

15. The luggage case system of claim 14, wherein the second tab is configured to slide into the first opening until the elastically bent pressure tab is positioned in the second opening such that the pressure tab is allowed to return to the first position when the clip reaches a closed engagement position.

16. The luggage case system of claim 15, wherein upon insertion into the closed engagement position and in the first position, the pressure tab is configured to prevent the clip from being removed from the closed engagement position.

17. The luggage case system of claim 16, wherein the pressure tab is configured to receive pressure from a user to elastically bend the pressure tab from the first position to the second position to allow the clip to be removed from the closed engagement position.

18. The luggage case system of claim 14, wherein the bridge of the clip abuts an edge of the slot of the wheel and handle assembly in a closed engagement position.

19. The luggage case system of claim 18, wherein the bridge is configured to be pushed such that the clip is moved into the closed engagement position.

20. A method for securing a case and a wheel and handle assembly of a luggage case system, the method comprising the steps of:

placing a case having a top, bottom, front, back, and sides onto a partial housing of a wheel and handle assembly, wherein the partial housing comprises an extendable handle, a bottom, back, and sides and said partial housing conforms in shape to that of said case, such that said bottom of said case may be placed on the bottom of the partial housing, and said back and sides of said case will engage the back and sides of said partial housing, said extendable handle secured to said back of the wheel and handle assembly whereby with said handle extended said case may be pulled by said handle;

engaging a first tab of at least one clip with a slot of the case configured to receive the first tab, wherein the clip is configured to engage the case and the wheel and handle assembly to readily releasably secure the case to the wheel and handle assembly and is further configured for disengagement from the case and from the wheel and handle assembly;

engaging a second tab of the clip with a slot of the wheel and handle assembly configured to receive the second tab of the clip, wherein the slot of the case and the slot of the wheel and handle assembly are complementary;

pushing a bridge of the clip to slide the clip into a closed engagement position to readily releasably secure the case to the wheel and handle assembly, wherein the bridge couples the first tab and the second tab.

21. The method of claim 20, further comprising the step of:

sliding the second tab of the clip through a first opening of the slot of the wheel and handle assembly.

22. The method of claim 21, wherein the step of sliding comprises the step of:

elastically bending a pressure tab of the second tab into a partial window of the second tab.

23. The method of claim 22, wherein the step of elastically bending comprises the step of:

elastically bending the pressure tab from a first position to a second position to allow the second tab of the clip to slide into the first opening.

24. The method of claim 23, wherein the step of sliding comprises the step of:

sliding the second tab of the clip through the first opening until the elastically bent pressure tab is in a second opening of the second tab such that the pressure tab is allowed to return to the first position when the clip reaches a closed engagement position.

25. The method of claim 24, further comprising the step of:

applying pressure to the pressure tab of the second tab of the clip to elastically bend the pressure tab to allow the clip to be removed from the closed engagement position to release the case from the wheel and handle assembly and to disengage the clip from the case and from the wheel and handle assembly.

* * * * *